US010532236B2

(12) United States Patent
Pahila

(10) Patent No.: US 10,532,236 B2
(45) Date of Patent: Jan. 14, 2020

(54) METHOD OF FIRE PROTECTION FOR STORAGE OCCUPANCIES UTILIZING A PLURALITY OF PENDENT CONTROL MODE SPECIFIC APPLICATION EXTENDED COVERAGE FIRE PROTECTION SPRINKLERS

(75) Inventor: Oliver S. Pahila, Liberty, SC (US)

(73) Assignee: The Reliable Automatic Sprinkler Co., Inc., Liberty, SC (US)

( * ) Notice: Subject to any disclaimer, the term of this patent is extended or adjusted under 35 U.S.C. 154(b) by 1464 days.

(21) Appl. No.: 12/867,742

(22) PCT Filed: Feb. 13, 2009

(86) PCT No.: PCT/US2009/034130

§ 371 (c)(1),
(2), (4) Date: Oct. 18, 2010

(87) PCT Pub. No.: WO2009/103006

PCT Pub. Date: Aug. 20, 2009

(65) Prior Publication Data

US 2011/0036598 A1 Feb. 17, 2011

Related U.S. Application Data

(60) Provisional application No. 61/028,418, filed on Feb. 13, 2008.

(51) Int. Cl.
*A62C 3/02* (2006.01)

(52) U.S. Cl.
CPC ..... *A62C 3/0292* (2013.01)

(58) Field of Classification Search
CPC ..... A62C 3/0292; A62C 37/12; A62C 3/002; A62C 35/68; B05B 1/265
(Continued)

(56) References Cited

U.S. PATENT DOCUMENTS 316,581 A 4/1885 Stratton
466,658 A 1/1892 Cumnock et al.
(Continued)

FOREIGN PATENT DOCUMENTS

EP 0759794 B 3/1997
EP 0898984 3/1999
(Continued)

OTHER PUBLICATIONS

Pendent Sprinkler has 25.2 K-factor. Apr. 9, 2003, http://news.thomasnet.com/fullstory/21191.
(Continued)

*Primary Examiner* — Arthur O. Hall
*Assistant Examiner* — Steven M Cernoch
(74) *Attorney, Agent, or Firm* — Venable LLP

(57) ABSTRACT

A fire protection method includes providing a plurality of pendent control mode specific application extended coverage fire protection sprinklers as components of a fire protection sprinkler system for a storage area defined by a storage height of at least 25 feet and a building height of at least 30 feet. Each sprinkler has a thermally responsive element, a deflector, and a K-factor of at least 25.2 gpm/(psi)$^{1/2}$, and is connected to a piping network at a height greater than the storage height. When each sprinkler is activated, a fluid is supplied to the sprinkler from the piping network at a pressure of at least 30 pounds per square inch, and is delivered to a coverage area of greater than 110 and up to and including 196 square feet per sprinkler. A design operating area of the sprinkler system is up to six sprinklers or 1200 square feet.

11 Claims, 5 Drawing Sheets

(58) Field of Classification Search
USPC ..... 169/37, 38, 39, 40, 41, 42, 56, 57, 58, 169/59, 60, 61, 90, DIG. 3
See application file for complete search history.

(56) References Cited

U.S. PATENT DOCUMENTS

| | | | | |
|---|---|---|---|---|
| 733,646 | A | 7/1903 | Hibbard | |
| 720,013 | A | 10/1903 | Esty | |
| 776,614 | A | 6/1904 | Phelps | |
| 1,498,139 | A | 6/1924 | Williams | |
| 2,076,483 | A | 4/1937 | Rowley | |
| 2,135,138 | A | 11/1938 | Kendall | |
| 2,211,399 | A | 8/1940 | Winslow | |
| 2,389,333 | A | 11/1945 | Tyden | |
| 2,534,066 | A | 12/1950 | Rowley | |
| 2,697,008 | A | 12/1954 | Rowley | |
| 3,051,397 | A | 8/1962 | Hanson | |
| 3,346,051 | A | 10/1967 | Merdinyan | |
| 3,561,537 | A | 2/1971 | Bix | |
| 3,682,251 | A | 8/1972 | Livingston | |
| 3,743,022 | A * | 7/1973 | Livingston | 169/16 |
| 3,874,455 | A | 4/1975 | Klesow | |
| 4,014,388 | A | 3/1977 | Anderson | |
| 4,091,873 | A | 5/1978 | Werner | |
| 4,099,675 | A | 7/1978 | Wohler et al. | |
| 4,273,195 | A | 6/1981 | Fischer et al. | |
| 4,296,815 | A | 10/1981 | Mears | |
| 4,580,729 | A | 4/1986 | Pounder | |
| 4,711,399 | A | 12/1987 | Rosenberg | |
| 4,732,216 | A | 3/1988 | Polan | |
| 4,757,865 | A | 7/1988 | Simons | |
| 4,830,115 | A | 5/1989 | Polan | |
| 4,923,013 | A | 5/1990 | DeGennaro | |
| 5,020,601 | A | 6/1991 | Retzloff et al. | |
| 5,072,792 | A | 12/1991 | Simons et al. | |
| 5,203,416 | A | 4/1993 | Takeuchi et al. | |
| 5,372,203 | A | 12/1994 | Galaszewski | |
| 5,392,993 | A | 2/1995 | Fischer | |
| 5,579,846 | A | 12/1996 | Meyer et al. | |
| 5,584,344 | A | 12/1996 | Meyer et al. | |
| 5,609,211 | A | 3/1997 | Meyer et al. | |
| 5,632,339 | A | 5/1997 | Fenske et al. | |
| 5,664,630 | A | 9/1997 | Meyer et al. | |
| 5,687,914 | A | 11/1997 | Bosio et al. | |
| 5,829,684 | A | 11/1998 | Fischer | |
| 5,839,667 | A | 11/1998 | Fischer | |
| 5,862,994 | A | 1/1999 | Pounder et al. | |
| 5,865,256 | A | 2/1999 | Pounder | |
| 5,890,657 | A | 4/1999 | Ponte | |
| 5,915,479 | A | 6/1999 | Ponte | |
| 6,026,907 | A | 2/2000 | Pahila | |
| 6,059,044 | A * | 5/2000 | Fischer | A62C 31/02 169/37 |
| 6,098,718 | A | 8/2000 | Sato | |
| 6,276,460 | B1 | 8/2001 | Pahila | |
| 6,446,732 | B1 | 9/2002 | Polan | |
| 6,450,266 | B1 | 9/2002 | Pahila | |
| 6,502,643 | B1 | 1/2003 | Meyer et al. | |
| 6,516,893 | B2 | 2/2003 | Pahila | |
| 6,585,054 | B1 * | 7/2003 | Thomas et al. | 169/37 |
| 6,799,639 | B2 | 10/2004 | Sato et al. | |
| 7,343,980 | B2 | 3/2008 | Pahila | |
| 7,624,812 | B2 | 12/2009 | Pahila | 169/37 |
| 2002/0096580 | A1 | 7/2002 | Pahila | |
| 2003/0111237 | A1 | 6/2003 | Sato et al. | |
| 2005/0035022 | A1 | 2/2005 | Ide et al. | |
| 2005/0178564 | A1 | 8/2005 | Orr | |
| 2006/0060361 | A1 * | 3/2006 | Pounder | A62C 37/11 169/37 |
| 2007/0246232 | A1 | 10/2007 | Pahila | |
| 2008/0073088 | A1 | 3/2008 | Ide et al. | |

FOREIGN PATENT DOCUMENTS

| | | | |
|---|---|---|---|
| EP | 1264616 | A1 | 12/2002 |
| GB | 1412348 | | 11/1975 |
| GB | 2049415 | | 12/1980 |
| GB | 2333702 | | 8/1999 |
| GB | 2337199 | | 6/2002 |
| JP | 2001046544 | | 2/2001 |
| WO | 01/54772 | | 8/2001 |
| WO | 01/64289 | | 9/2001 |
| WO | 2007/095245 | A2 | 8/2007 |

OTHER PUBLICATIONS

"Ordinary Hazard Group 3-Protection Using Enhanced Protection Extended Coverage Sprinklers," Technical Bulletin 222:2004:1.
"Sprinkler Protection of Concealed Spaces in OH3 EPEC Sprinklered Buildings," Technical Bulletin 223:2004:1.
Newsletter No. 19, British Automatic Sprinkler Association Limited, Mar. 2005.
"Introduction of the new EPEC sprinkler," Tyco Building Services Products, http://www.tycobuilding.com/cgi-bin/webscripts/nph-news.pl?id=1537.
"Launch Package EPEC Sprinkler," http://www.tycobuilding.com/user/PDF/FireProtection/EPEC_Launch_Internet.pdf.
"Viking ESFR Pendent K25.2 Sprinkler SIN VK510," The Viking Corporation, Hastings, Michigan, Jun. 10, 2005.
Canadian Official Action dated Nov. 30, 2016, in corresponding Canadian Patent Appln. No. 2,713,081.
Canadian Official Action dated Sep. 13, 2017, in corresponding Canadian Patent Appln. No. 2,713,081.
European Patent Office Search Report dated Feb. 11, 2016, in corresponding European Patent Appln. No. 09709711.7.

* cited by examiner

METHOD OF FIRE PROTECTION FOR STORAGE OCCUPANCIES UTILIZING A PLURALITY OF PENDENT CONTROL MODE SPECIFIC APPLICATION EXTENDED COVERAGE FIRE PROTECTION SPRINKLERS

This application is a national stage application under 35 U.S.C. § 371 of International Patent Application No. PCT/US2009/034130, filed Feb. 13, 2009, which claims the benefit of priority under 35 U.S.C. § 119(e) to U.S. provisional patent application 61/028,418, filed Feb. 13, 2008, the entire contents of which, including Appendices 1-5, are incorporated by reference as if fully set for herein. Also, this application refers to U.S. patent application Ser. No. 11/408,868 (now U.S. Pat. No. 7,624,812), filed on Apr. 20, 2006, the entire contents of which are incorporated by reference as if fully set forth herein.

BACKGROUND OF THE INVENTION

Field of the Invention

The present invention relates to an automatic fire protection sprinkler and a method of fire protection for storage occupancies, and, in particular, an extended coverage, storage special application sprinkler and a method of using the sprinkler relates to in accordance with a minimum pressure and number of sprinklers to be calculated design criteria.

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or a fusible link, and may also include a latching mechanism.

Certain conventional sprinklers have a pair of arms that extend from the base portion and meet at a hub portion to form a frame. The hub portion is spaced apart from the output orifice of the base portion and is aligned with a longitudinal axis thereof. The hub portion may have a set-screw configured to apply a pre-tension force to the release mechanism. A deflector may be mounted on the hub, transverse to the output orifice, to provide dispersion of the output fluid.

Fire protection sprinklers may be mounted on a fluid conduit running along a ceiling and may either depend downward from the conduit, which is referred to as a "pendent" configuration, or may extend upward, which is referred to as an "upright" configuration. Alternatively, a sprinkler may be mounted on a wall, a certain distance below the ceiling, which is referred to as a "horizontal sidewall" configuration. Horizontal sidewall sprinklers have an output orifice that is oriented so that the fluid is output horizontally and sprays onto an area to be protected in front of the sprinkler.

An "extended coverage storage sprinkler (density/area)," as described in Section 5.11 of UL 199 ("Standard for Automatic Sprinklers for Fire-Protection Service," Underwriters' Laboratories, 11$^{th}$ Ed., Nov. 4, 2005) is a sprinkler that is intended to be installed using the extended coverage area (e.g., 14 feet by 14 feet) and density/area criteria specified in NFPA 13 ("Standard for the Installation of Sprinkler Systems," National Fire Protection Association, Inc., 2002 Edition). These sprinklers incorporate a heat responsive element and release mechanism that has a response time equal to or less than a standard response sprinkler used on sprinklers designed for standard spacings (e.g., 12 feet by 12 feet). NFPA 13 defines a number of different types of storage sprinklers. Section 12.7.2, for example, provides "Sprinkler Design Criteria for Storage and Display of Class I through Class IV Commodities, Cartoned Non-Expanded Group A Plastics, and Non-Expanded Exposed Group A Plastics in Retail Stores." In such applications, the sprinkler must be connected to a wet pipe system designed to meet two separate design points: 0.6 gpm/ft$^2$ density over 196 ft$^2$ and 0.7 gpm/ft$^2$ density for the four hydraulically most demanding sprinklers (e.g., the four sprinklers furthest from the source).

A fire protection sprinkler can also be characterized by size according to a K-factor defined by $K=Q/\sqrt{p}$, where Q is the flow rate in gallons per minute, and p is the residual pressure at the inlet of the sprinkler in pounds per square inch.

NFPA 13-1999, section 5-4.1.2, states that "For general storage, rack storage, rubber tire storage, roll paper storage, and baled cotton storage being protected with spray sprinklers with required densities of 0.34 gpm/ft$^2$ (13.9 mm/min) or less, standard response sprinklers with a nominal K-factor of 8.0 gpm/(psi)$^{1/2}$ or larger shall be used. For required densities greater than 0.34 gpm/ft$^2$ (13.9 mm/min), standard response spray sprinklers with a K-factor of 11.2 gpm/(psi)$^{1/2}$ or larger that are listed for storage applications shall be used."

Modifications to NFPA 13 standards used for approving control mode storage sprinklers have been proposed that would require sprinklers to be tested according to a fixed inlet pressure and a fixed number of sprinklers calculated, instead of meeting density area requirements. Due to the proposed standards changes, control mode sprinklers approved for use based upon the existing density/area requirements may not meet the proposed standards.

High pile storage as defined by NFPA 13 is solid-piled, palletized, rack storage, bin/box, and shelf storage in excess of 12 feet in height. Commodities can be classified in classes one through four and sub classified into groups A or B plastics. In general, the building construction and the layout of the storage space below the location of the sprinkler affects the fire protection requirements. Depending on the building layout, sprinklers may be obstructed or unobstructed by objects below them. When a sprinkler is obstructed, the sprinkler must be specifically listed for that application.

Fire sprinklers for storage applications are designed, tested, and installed to provide two different types of protection, fire control, or fire suppression. There are various types of storage sprinkler types, e.g., density/area control mode (DACM), control mode specific application (CMSA), and early suppression fast response (ESFR). Sprinklers may be specified as standard coverage or extended coverage sprinklers. Standard coverage corresponds to a sprinkler that can provide coverage up to 100 ft$^2$ (9.3 m$^2$). Extended coverage corresponds to a sprinkler that can provide coverage of 196 ft$^2$ (18.2 m$^2$) or more. In general, automatic fire protection sprinkler systems are designed and installed according to FM Global Property Loss Prevention Data Sheet 2-8N, entitled 'Installation of Sprinkler Systems'.

Density/area control mode (DACM) fire protection sprinklers are specified according to a specific water density delivered by the sprinkler over a specified area of coverage. Fire control using density/area sprinklers limits the size of the fire by decreasing the heat release rate, pre-wetting adjacent combustibles, and controlling ceiling gas temperature to avoid structural damage. Some factors affecting the system design for density/area protection are the commodity sought to be protected, the storage arrangement, the storage height, the clearance from the top of the storage to the ceiling sprinklers, flue spaces, shelving, encapsulation, and aisle width. In order to properly design a system based upon a control mode density/area requirement, it is necessary to account for the type of piping system in which the sprinklers will be used (i.e., a wet or a dry pipe system), the clearance between the sprinklers and the commodity, the temperature rating of the sprinkler, and whether sprinklers will be used in the storage racks. Typically, density/area sprinklers are selected and used according to classification of use in an appropriate NFPA 13 density/area table and applying a correct modifying factor, based on one or more of the factors noted above, to determine the suitable sprinkler. Selecting the wrong table or misapplication of any of the modifying factors can be detrimental to providing adequate fire control. Typical standard coverage density/area sprinklers have K-factors that include 5.6, 8.0, 11.2, 14.0, and 16.8 gpm/(psi)$^{1/2}$, and typical extended coverage density/area sprinklers have K-factors of 25.2 gpm/(psi)$^{1/2}$ and above.

As noted above, CMSA sprinklers limit the size of the fire by decreasing the heat release rate, pre-wetting adjacent combustibles, and controlling ceiling gas temperature to avoid structural damage. CMSA sprinklers are designed and tested for specific storage applications, such as heights, commodities, etc. Commodities may be classified according to FM Global Property Loss Prevention Data Sheet 8-9, entitled 'Storage of Class 1, 2, 3, 4 and Plastic Commodities'. Systems using a CMSA sprinkler are designed according to FM Global Property Loss Prevention Data Sheet 2-7, entitled 'Installation Rules for Sprinkler Systems Using Control Mode Specific Application (CMSA) Ceiling Sprinklers for Storage Applications'. CMSA sprinklers are specified according to a minimum inlet pressure of the fire protection fluid. Unlike density/area control mode (DACM) sprinkler systems, however, systems using CMSA sprinklers are designed according to the listing criteria of the sprinkler and whether the sprinkler is used in a wet or a dry pre-action system. The characterization of a CMSA sprinkler is based on actual fire testing of the sprinkler using a minimum inlet pressure to the sprinklers and a specified minimum number of sprinklers to be calculated to cover a specific area. As a result, when designing a fire protection system using CMSA sprinklers, neither reference to density/area charts or curves nor application of modifying factors is necessary, which can reduce errors in selecting system components caused by the use of such tables.

ESFR sprinklers use fast response mechanisms to deliver large quantities of water to penetrate a fire plume to the burning fuel surface and sharply reduce the heat release rate to prevent regrowth of the fire. One advantage of ESFR sprinklers is that sprinklers need not be placed within a storage rack that stores a commodity, providing flexibility in locating storage racks and commodities stored thereon in a storage area, such as a warehouse. ESFR sprinklers can only be used, however, in wet pipe systems for special application use, and they are especially sensitive to obstructions caused by building configurations. Moreover, use of ESFR sprinklers in a special application environment requires a high pressure fluid source, which increases the cost and complexity of the system, whether for new construction or for retrofitting existing buildings. In some cases, retrofitting the fire protection system with an ESFR sprinkler system for a special application use may require redesign of the building structure. Some examples of typical obstructions include cross-bracing or bridging in rafters of buildings below the sprinkler head, light fixtures below the sprinkler head, duct work, cable trays, and conduits below the sprinkler head. Moreover, since ESFR sprinklers are standard-coverage, a greater number of sprinklers are required to be used to provide fire protection as compared to a system in which extended coverage sprinklers are used.

SUMMARY OF THE INVENTION

In one aspect of the invention, a fire protection method comprises providing at least one control mode specific application extended coverage sprinkler for storage applications having a K-factor of at least 14 gpm/(psi)$^{1/2}$ that is connectable to a piping network to protect commodity hazards including class one through four and Group A cartoned unexpanded plastics, as defined in National Fire Protection Association Standard 13 and FM Global Property Loss Prevention Data Sheets 8-1 and 8-9, stored in a storage area defined by a storage height of at least 25 feet, and a building height of at least 30 feet, wherein the sprinkler provides coverage to an area of at least 144 square feet. The method also includes connecting the at least one sprinkler to the overhead piping network at a height above the storage height, activating the sprinkler in the event of a fire condition sensed by the sprinkler head, and delivering a fluid fed to the sprinkler to a coverage area of at least 144 square feet.

In another aspect, our invention provides a fire protection sprinkler system.

Yet another aspect of the invention provides a control mode specific application extended coverage sprinkler for storage applications having a K-factor of between 14 and 28 gpm/(psi)$^{1/2}$.

In still another aspect, the present invention provides a pendent fire protection sprinkler, including a deflector having a first pair of opposed slots, a second pair of opposed slots at about 90° from the first pair of slots, a third pair of opposed slots, positioned between both the first and second pairs of opposed slots, and a plurality of angled slots, positioned between the first and third pairs of opposed slots and the second and third pairs of opposed slots.

Embodiments of the present invention may include one or more of the following features.

The deflector may be a planar, circular disk having a diameter of about 1.6 to about 2.1 inch. The first and second pairs of opposed slots may have a radial length of about 0.4 to about 0.5 inch. The third pair of opposed slots may have a radial length of about 0.5 to about 0.7 inch. The angled slots may have a radial length of about 0.15 to about 0.20 inch.

The first and second pairs of slots may have a radial length of about 20% to about 30% of a diameter of the deflector. The third pair of opposed slots may have a radial length of about 28% to about 38% of a diameter of the deflector. The angled slots may have a radial length of about 7% to about 12% of a diameter of the deflector.

A center line of the angled slots may form an angle of about 20° to about 50° with respect to a radial line extending from a center of the deflector through inner ends of the angled slots. The inner ends of the angled slots may be positioned about 15° to about 30° from the nearest slot of the first and second pairs of slots. The third pair of opposed slots may form an angle of about 40° to about 50° with the first and second pairs of slots.

The sprinkler may achieve a water discharge density of 0.6 gpm/ft$^2$ density over an area of 196 square feet, and the nominal K-factor may be 25.2 gpm/(psi)$^{1/2}$.

In still another aspect, the present invention provides a pendent fire protection sprinkler for storage applications, the pendent fire protection sprinkler having a body including a fluid passage and an output orifice sealed with a seal cap, two arms extending from the body and meeting at a hub, a release mechanism with a thermally-responsive element positioned between the seal cap and the hub, and a deflector positioned on the hub and facing the output orifice. The deflector includes a plurality of aligned slots at about 90° from each other, a plurality of corner slots located between the aligned slots, and a plurality of angled slots located between the aligned slots and the corner slots.

These and other objects, features, and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

In a first aspect, the invention provides a control mode special application extended coverage sprinkler for storage applications that connects to a piping network to protect commodity hazards including class one through four and Group A cartoned unexpanded plastics stored in a storage area in accordance with National Fire Protection Association Standards 13. The control mode special application extended coverage sprinkler for storage applications includes a body defining a passageway between an inlet and an outlet along a longitudinal axis, with the outlet being closer to an area to be protected than the inlet, and the passageway having a rated K-factor of at least 14 gpm/(psi)$^{1/2}$, and preferably at least 25.2 gpm(psi)$^{1/2}$. The sprinkler also includes a closure positioned proximate to the outlet opening so as to occlude the passageway in an unactuated state, a heat responsive trigger that retains the closure to occlude the passageway, and a deflector assembly. The deflector assembly can distribute fluid fed to the inlet, and through the passageway and the outlet, while providing coverage of at least up to 144 ft$^2$ to protect commodity hazards including class one through four and Group A cartoned unexpanded plastics stored in a storage area defined by a storage height of at least 25 feet, and a building height of at least 30 feet, when the heat responsive trigger is actuated to permit flow through the outlet.

Figure 1:
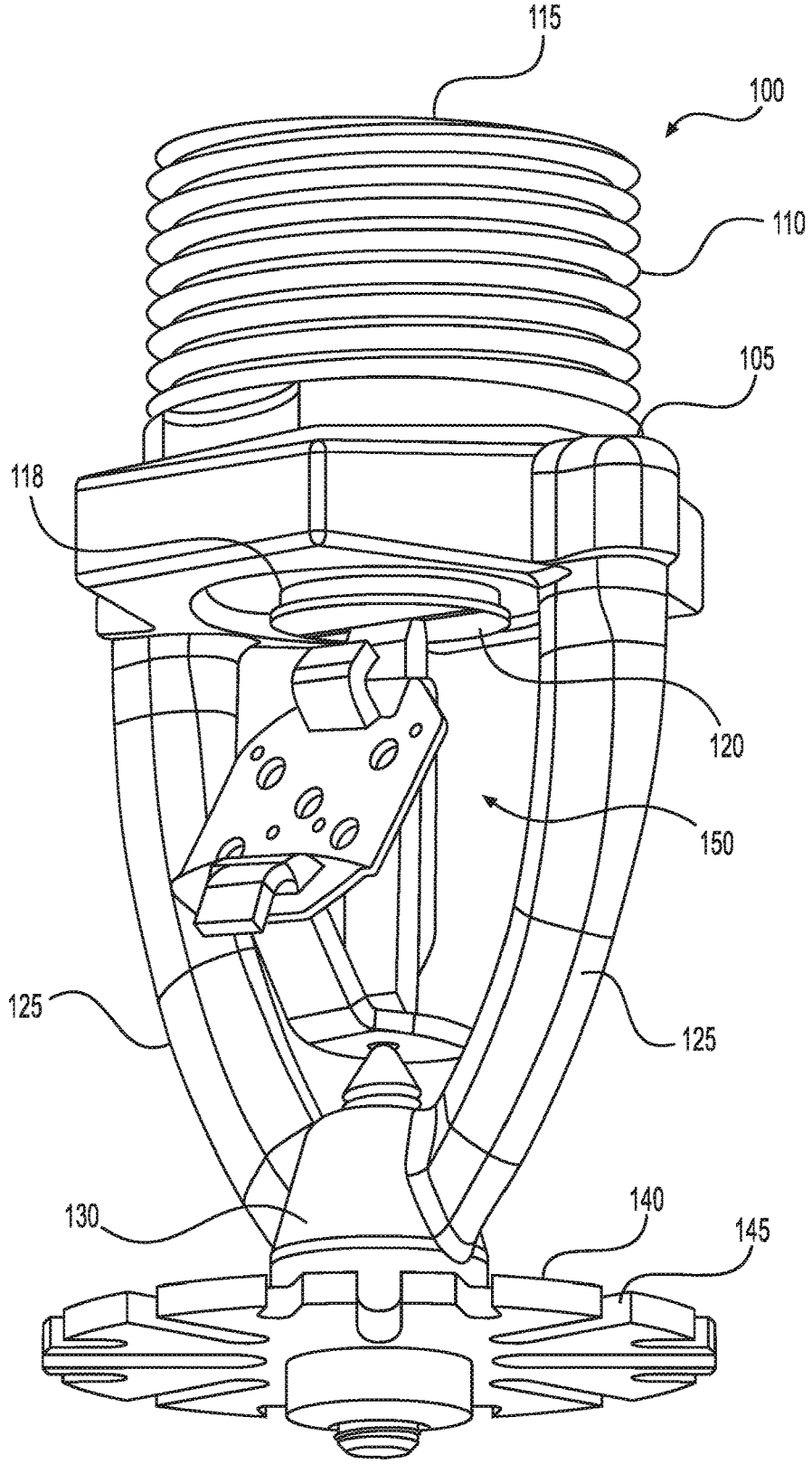
FIG. 1 is a perspective view of a pendent sprinkler in accordance with the present invention and used in the method of the present invention.

FIG. 1 shows a pendent sprinkler 100 of the present invention, the sprinkler 100 having a body 105 defining an axial fluid passage having an input orifice 115 and an output orifice 118, and which may have the features of any of the sprinklers disclosed in U.S. patent application Ser. No. 11/408,868, now U.S. Pat. No. 7,624,812. The top of the body 105 has a threaded portion 110 on an outer surface to allow the sprinkler 100 to be connected to a conduit (not shown) for providing a pressurized fire-extinguishing fluid, such as water, to an input end near the input orifice 115 of the fluid passage. The output orifice 118 is provided at an opposite end of the fluid passage relative to the input orifice 115, and is sealed by a seal cap 120. The input orifice 115 may have a diameter of, for example, 1 inch NPT (national pipe thread). The sprinkler 100 may have a K-factor of, for example, 25.2 gpm/(psi)$^{1/2}$, that, as mentioned above, is defined by $K=Q/\sqrt{p}$, where Q is the flow rate in gallons per minute, and p is the residual pressure at the inlet of the sprinkler in pounds per square inch.

Two frame arms 125 extend from a lower portion of the body 105, and meet at a hub 130, that is positioned below and is in axial alignment with the output orifice 118. A deflector 140 is positioned and mounted on the hub 130 so as to be impinged by the fluid that passes through the fluid passage upon activation of the sprinkler 100. As further discussed below, the deflector 140 in this particular embodiment is a circular, planar disk that is centered on and orthogonal to the axis of the fluid passage. The deflector 140, i.e., the disk, has a number of slots 145 of varying length and orientation arrayed around its periphery.

A release mechanism, e.g., a fusible link assembly 150, having a thermally-responsive element, e.g., a fusible link 235, is positioned between the hub 130 and the seal cap 120 to hold the seal cap 120 in place over the output orifice 118. As shown in the sectional view of FIG. 2, the link assembly 150 includes a lever 205 positioned on a set screw 210 that extends upward from the hub 130. A strut 215 is positioned between the seal cap 120 and the lever 205, such that one end of the strut 215 is positioned in a slot 220 on the surface of the seal cap 120 and the other end of the strut 215 is positioned in a slot 225 on the lever 205, slightly offset from an axis of the set screw 210.

Figure 2:
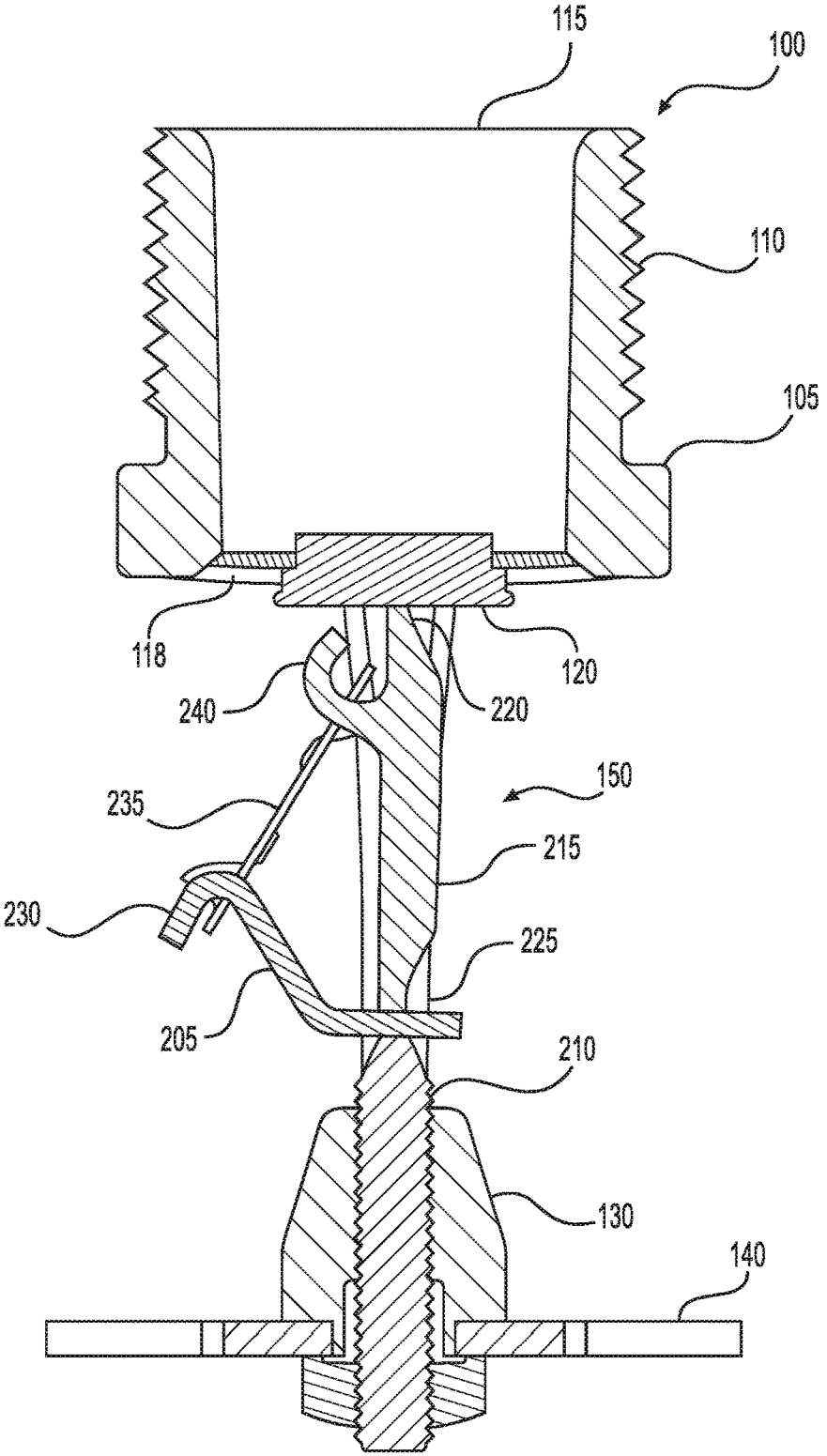
FIG. 2 is a sectional view of the pendent sprinkler of FIG. 1, in a plane perpendicular to the plane of the frame arms.

The pressure of the fluid on the seal cap 120 causes a downward force to act on the strut 215, which, in turn, causes an extended end 230 of the lever 205 to tend to rotate away from the strut 215 (i.e., the lever 205 rotates counter-clockwise in the view of FIG. 2). The rotational force on the lever 205 creates a tension force on the fusible link 235 that is attached to the extended end 230 of the lever 205 and to a hook 240 provided on an upper portion of the strut 215.

The fusible link 235 comprises two thin, metal plates, e.g., beryllium-nickel alloy, one connected to the lever 205 and the other connected to the strut 215. The plates are joined in an overlapping manner with solder that melts at a predetermined temperature. The fusible link 235 separates at the predetermined temperature, due to the tension force applied by the lever 205 and the strut 215, allowing the lever 205 and the strut 215 to swing outward. This in turn releases the seal cap 120 and allows the fluid to be output from the output orifice 118. Of course, other types of release mechanisms may be used, including, but not limited to, for example, a frangible bulb or a sensor, strut, and lever assembly.

Figure 3:
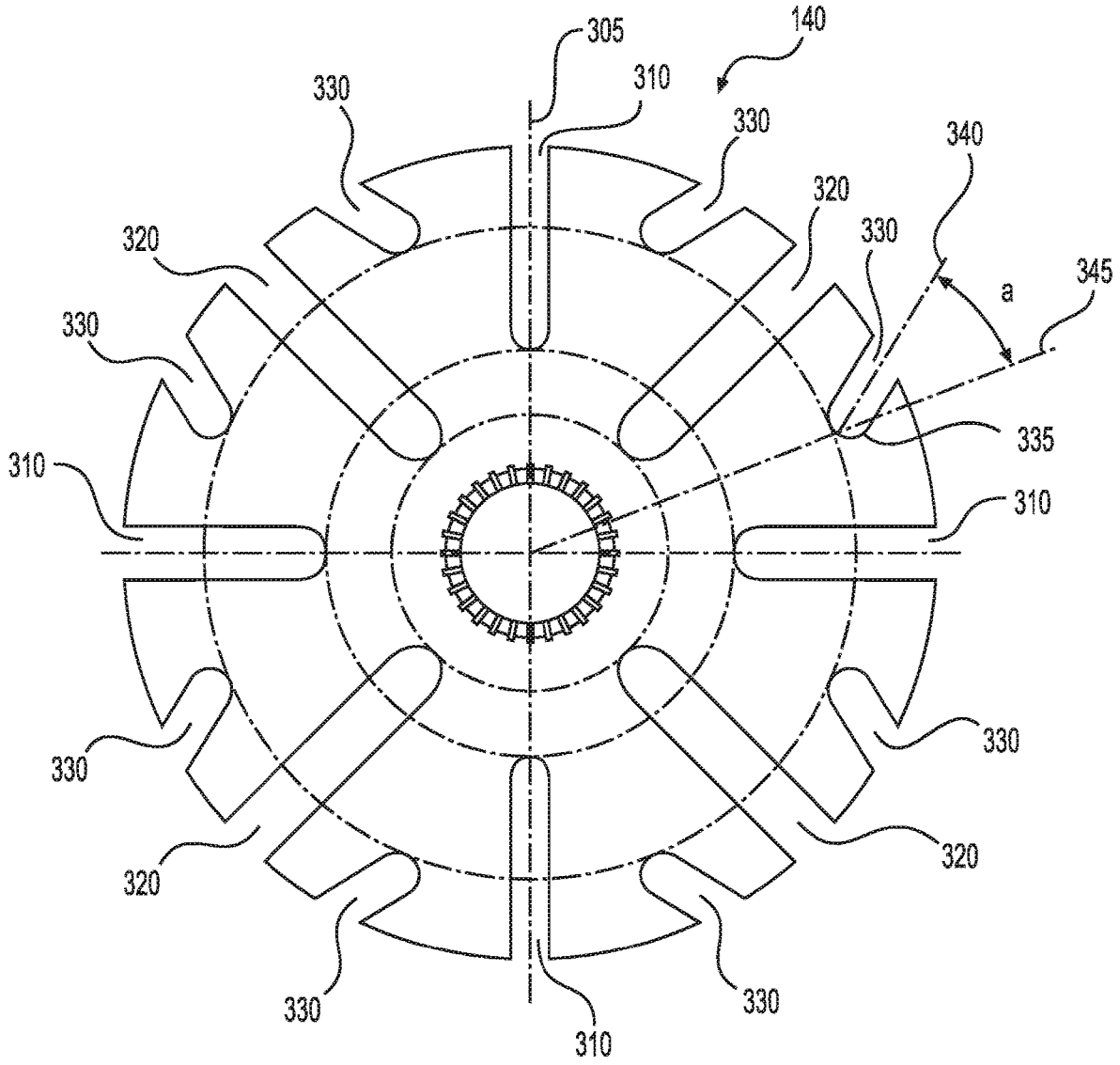
FIG. 3 is a plan view of the deflector of the sprinkler of FIG. 1, showing the surface that faces away from the outlet orifice.

FIG. 3 shows an embodiment of the deflector 140, which, as noted above, is a circular, planar disk having a number of slots of varying length and orientation arrayed around its periphery. The deflector 140 may be formed, for example, of phosphor bronze and may have a diameter of about 1.85 inches and a thickness of about 0.08 inch. In alternative embodiments, the diameter of the deflector 140 may vary by about ±15%. The deflector 140 may be planar, as shown in this embodiment, or may be curved or bent, so that an outer portion of the deflector 140 extends away from the output orifice 118.

The positions of the slots 145 may be described in terms of the approximate angle between each slot and a reference line 305 extending vertically though the planar view of the disk shown in FIG. 3. In the exemplary embodiment, there is a set of four slots 310 (the "aligned slots") provided in a perpendicular configuration so that each of the four slots 310 is opposite to another one of the four slots 310 and is positioned at an angle of 90° relative to another one of the four slots 310. Two of the four slots 310 that oppose each other align with the reference line 305. In addition, each of the slots 310 has a radial length of about 0.46 inch (which is about 25% of the deflector diameter) and a width of about 0.11 inch. In alternative embodiments, the length of these slots 310 may vary by up to about ±15%.

There is also a set of four slots 320 (the "corner slots"), each provided at 45° from the reference line 305, and having a radial length of about 0.61 inch. (about 33% of the deflector diameter) and a width of about 0.125 inch. In alternative embodiments, the length of these slots 320 may vary by up to about ±15%.

There is also a set of eight slots 330 ("the angled slots") that are oriented to form an angle (a) of about 35° between a center line 340 of one of the angled slots 330 and radial lines 345 passing through inner ends 335 of the angled slots 330 (i.e., passing through the origin of the radius of the inner end). In alternative embodiments, the angle $\alpha$ may vary between about 20° to about 50°. The angled slots 330 have a radial length (i.e., the distance from the inner end to the outside edge of the deflector along the radial line 345) of about 0.175 inch. (about 9% of the deflector diameter) and a width of about 0.1 inch. In alternative embodiments, the length of the angled slots 330 may vary by up to about ±15%. The inner ends 335 of the angled slots 330 are positioned about midway between the aligned slots 310 and the corner slots 320 (i.e., the angled slots 330 are at about 22.5° or at about 67.5° from the reference line 305).

The slots 145 discussed above have rounded inner ends that are approximately semicircular, with a radius equal to half of the slot width, but other geometries may also be used. Of course, the deflector 140 may have other slots in addition to those described above.

In accordance with UL 199, storage, area/density sprinklers are tested in a large scale fire test, in which an array of sprinklers is installed over predetermined configurations of commodities, e.g., a double-row rack of standard, cartoned Group A plastic commodities, beneath a smooth, flat, non-combustible ceiling. The water flow from the sprinklers must be controlled by the deflector to achieve an output pattern that meets the required water discharge density specified for the sprinkler. Representative sprinklers are installed at a specified spacing for each fire test, which is 14 feet for extended coverage sprinklers having a K-factor of 25.2 gpm/(psi)$^{1/2}$. The ignition point for the fire test is positioned either beneath a single sprinkler, between two sprinklers on the same branch line, or in the center of four sprinklers (i.e., at the center of a 14 feet by 14 feet square).

In order to maintain the proper density of water output over the specified area, the sprinkler 100 must have a spray pattern that is approximately square. Thus, the sprinkler 100 must be configured to throw water farther in the direction of the corner slots 320 (i.e., a direction that is 45° from the reference line 305), relative to the aligned slots 310 (0° and 90° from the reference line 305). This is particularly important for the test in which the ignition point is centered among four sprinklers, because the ignition point will be aligned with the corner slots 320 of each of the four sprinklers (i.e., in the corner of the approximately square pattern of each sprinkler).

To achieve the approximately square spray pattern, the corner slots 320 are designed to be somewhat longer than the aligned slots 310, in order to project more water toward the corners of the spray pattern. Likewise, the angled slots 330 are angled toward the corners of the spray pattern, which further tends to create a square spray pattern. In addition, directing the output water toward the corners of the spray pattern lessens the amount of water output toward adjacent sprinklers. This helps to prevent "cold soldering," which is a condition in which water is output by a sprinkler directly onto an adjacent sprinkler, thereby lowering the temperature of the adjacent sprinkler and preventing the adjacent sprinkler from properly activating. Moreover, the longer corner slots 320 extend to the outside diameter of the hub in order to deliver a thrust force (i.e., a stream of water directed straight downward) for single head protection when fire occurs directly underneath the head. Tests conducted with a single sprinkler positioned directly over a fire verified that that the sprinkler was actuated and functioned to control the fire.

Figure 4:
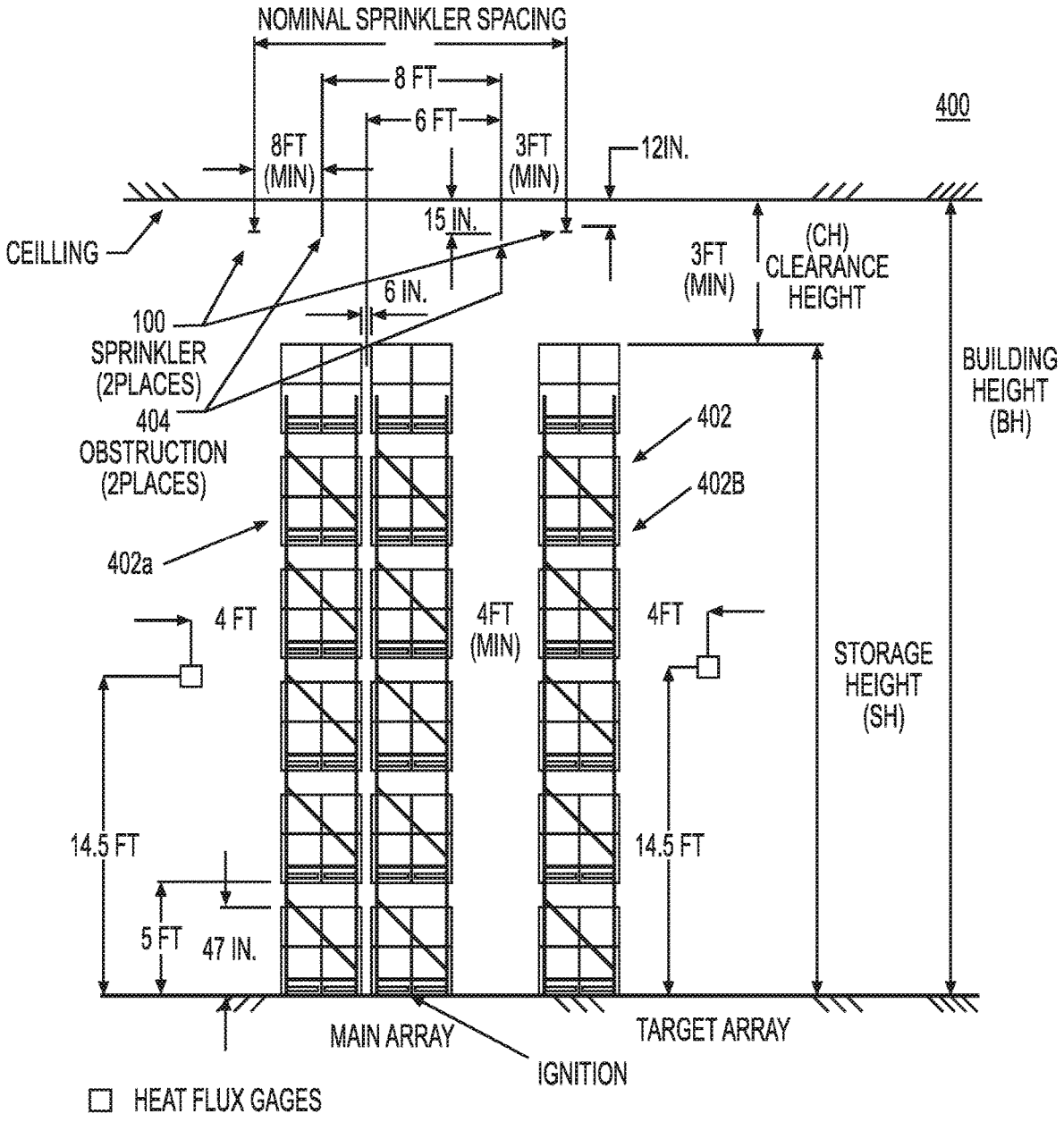
FIG. 4 is an elevation view of a test array configured in accordance with an embodiment of the invention.
Figure 5:
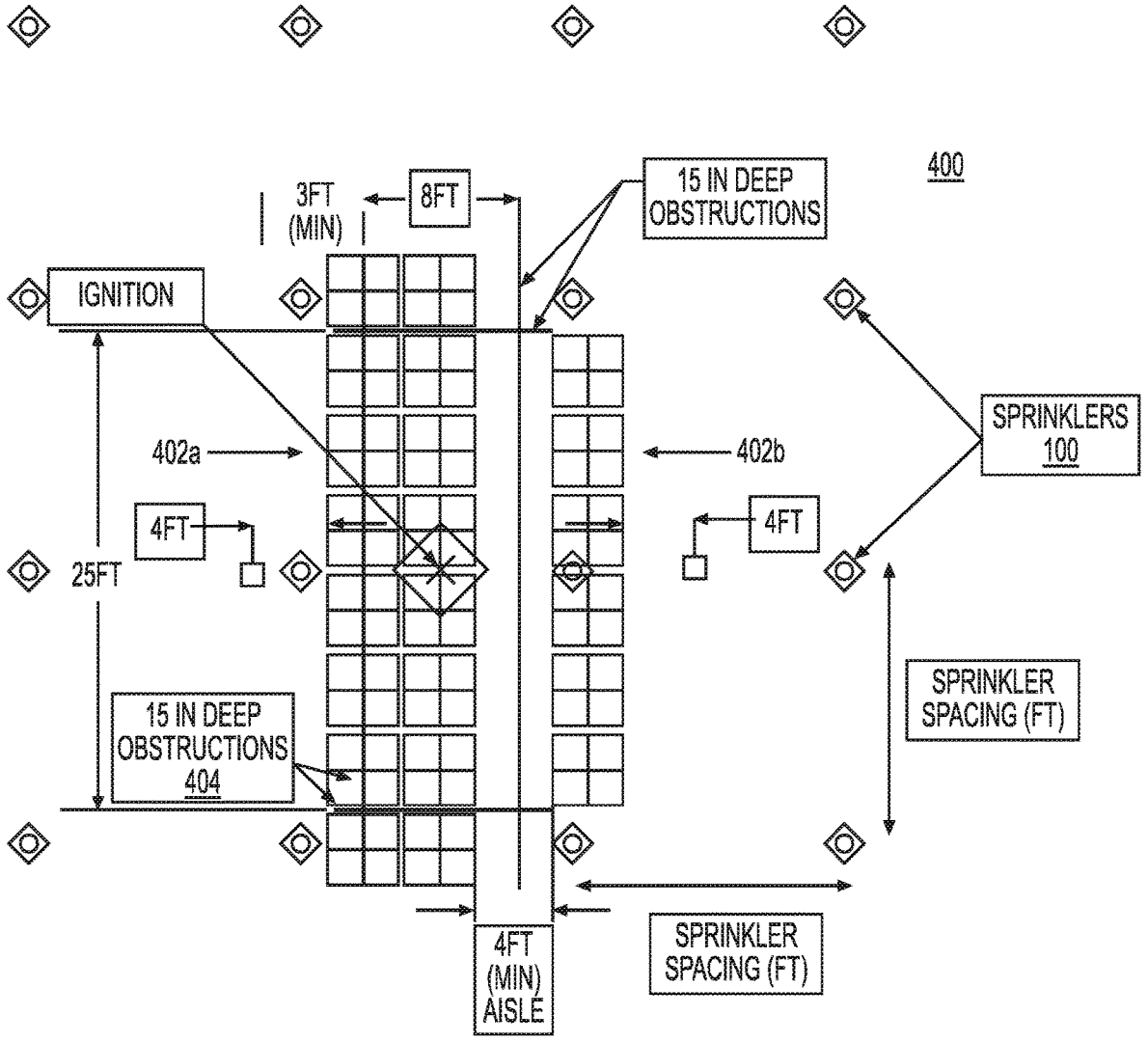
FIG. 5 is a plan view of the test array, shown in FIG. 4.

An embodiment of the extended coverage sprinkler discussed above, such as that shown in FIG. 1, has also been tested according to the proposed fixed pressure/fixed number of sprinklers calculated design requirements described above. FIGS. 4 and 5 show a testing configuration used to test the sprinkler according to the proposed fixed pressure/fixed number of sprinklers design requirements. The arrangement of the commodity hazard, shown as an elevation view in FIG. 4, is representative of a test arrangement used by FM Global Property Insurance Group, of Johnston, R.I., in evaluating the performance of various embodiments of the invention described herein. The CMSA storage sprinklers configured in accordance with the invention were tested in a large scale fire test, in which an array of sprinklers is installed over predetermined configurations of commodities, e.g., a double-row rack of standard, cartoned Group A unexpanded plastic commodities, beneath a smooth, flat, non-combustible ceiling. The sprinklers were located at a predetermined distance (clearance height, CH) above the top of a commodity hazard having a storage height (SH), and were located another predetermined distance below the ceiling of a building having a building height (BH). In one embodiment, the minimum clearance height is 3 feet. Representative sprinklers are installed at a specified spacing for each fire test, which is, in one embodiment, 14 feet for extended coverage sprinklers having a K-factor of 25/2 gpm/(psi)$^{1/2}$. The ignition point for the fire test is positioned either beneath a single sprinkler, between two sprinklers on the same branch line (as shown in FIGS. 4 and 5), or in the center of four sprinklers (i.e., at the center of a square 14 feet on each side). Such sprinklers are tested at various building heights and storage heights, and with varying inlet fluid pressures to the sprinklers. The water flow from a minimum number of activated sprinklers is controlled by the deflector to effectively protect a certain coverage area below the sprinklers when the sprinklers are positioned at a certain spacing from one another.

An embodiment of a sprinkler configured in accordance with the invention having a K-factor of 25.2 gpm/(psi)$^{1/2}$ was tested over a class I-IV and Group A cartooned unexpanded plastic hazard having a storage height of 25 feet The building height was 30 feet. The sprinklers were connected to the piping network, running between the sprinklers and the building ceiling, that is capable of delivering fluid to any activated sprinklers at a pressure of at least 30 psi gauge. The sprinklers were tested with a maximum spacing of 14 feet×14 feet. The fire test was conducted and showed that six sprinklers would protect an area of 1200 square feet. Under those conditions, the sprinkler was deemed to be compliant with FM Global Property Loss Prevention Data Sheets 2-8N classification of occupancies, including classes I-IV and Group A cartoned unexpanded plastics, for commodities in any or all of the following configurations: solid-piled, palletized, shelved, bin-boxed, open frame single row racks (SRR), double row racks (DRR), multiple row racks (MRR), or portable rack storage.

The extended coverage sprinkler shown in FIG. 1 was further tested according to the proposed fixed pressure/fixed number of sprinklers design requirements described above. In particular, a sprinkler configured in accordance with the invention having a K-factor of 25.2 gpm/(psi)$^{1/2}$ was tested with a fixed inlet pressure of 40 psi gauge. The test was conducted for protecting a storage area having a storage height of 30 feet and a building height of 35 feet. The sprinkler was tested with a maximum spacing of 12 feet×12 feet. As a result of the test, it was determined that nine sprinklers would protect an area of 1200 square feet. Under those conditions, that sprinkler was deemed to be compliant with FM Global Property Loss Prevention Data Sheets 2-8N classification of occupancies, including classes I-IV and Group A cartoned unexpanded plastics, for commodities in any or all of the following configurations: solid-piled, palletized, shelved, bin-boxed, open frame single row racks (SRR), double row racks (DRR), multiple row racks (MRR), or portable rack storage.

The extended coverage sprinkler shown in FIG. 1 was further tested according to the proposed design requirements (i.e., the fixed pressure/fixed number of sprinklers calculated), as described above. In particular, a sprinkler configured in accordance with the invention having a K-factor of 25.2 gpm/(psi)$^{1/2}$ was tested with a fixed inlet pressure of 60 psi gauge. The test was conducted for protecting a storage area having a storage height of 35 feet and a building height of 40 feet. The sprinkler was tested with a maximum spacing of 12 feet×12 feet. During the test, up to 9 sprinklers opened. Under those conditions, that sprinkler was deemed to be compliant with FM Global Property Loss Prevention Data Sheets 2-8N classification of occupancies, including classes I-IV and Group A cartoned unexpanded plastics, for commodities in any or all of the following configurations: solid-piled, palletized, shelved, bin-boxed, open frame single row racks (SRR), double row racks (DRR), multiple row racks (MRR), or portable rack storage.

In another aspect of the invention, a fire protection method comprises providing at least one control mode special application extended coverage sprinkler for storage applications having a K-factor of at least 14 gpm/(psi)$^{1/2}$. The sprinkler provided is connectable to a piping network to protect commodity hazards including class I-IV and Group A cartoned unexpanded plastics, as defined in National Fire Protection Association Standard 13 and FM Global Property Loss Prevention Data Sheet 2-8N. The protected commodity hazards are stored in a storage area defined by a storage height that is at least 25 feet, and a building height of at least 30 feet. The sprinkler also provides coverage to an area of at least 144 square feet (i.e., the sprinkler is provided at a spacing of 12 feet×12 feet from an adjacent sprinkler). The method also includes connecting the sprinklers to the overhead piping network at a height at least equal to the storage height, activating at least one of the sprinklers in the event of a fire condition sensed by the sprinkler, and delivering a fluid fed to the at least one sprinkler, with the sprinklers being spaced at a sprinkler nominal spacing of at least 12 feet×12 feet. The sprinklers are connected to the overhead piping network at a predetermined distance above the storage height and a predetermined distance below the building height. For example, in one embodiment, a deflector of the sprinkler is disposed at least 3 feet above the storage height and at least 1 foot below the building height.

As discussed above, FIG. 4 shows a sprinkler system 400 in accordance with an embodiment of the fire protection method and apparatus described above. In FIG. 4, a plurality of sprinklers 100 are connected to an overhead piping network (not shown). The sprinklers 100 can have a nominal K-factor between 14 and 28 gpm/(psi)$^{1/2}$. The sprinklers 100 and the piping network are located at a predetermined distance (clearance height, CH) above the top of a commodity hazard 402 having a storage height (SH), and are located another predetermined distance below the ceiling of a building having a building height (BH). The minimum clearance height of the sprinklers 100 above the commodity hazard 402 is 3 feet. The building height can be between 30 and 45 feet, and the storage height can be between 25 and 40 feet. As shown, the commodity hazard 402 is arranged in a first commodity storage array 402*a* and a second commodity storage array 402*b*. The storage arrays 402*a* and 402*b* are shown separated by an aisle having a certain minimum width. Various obstructions may be present in the building, such as beams, pipes, ceiling mounted equipment, etc. Such obstructions can trap heat rising during a fire condition below the obstruction, possibly resulting in delayed activation of sprinklers near the obstruction due to the delay in sensing a temperature rise. As shown in FIG. 4, two obstructions 404 running above and parallel to arrays 402*a*, 402*b* are 15 inches long and are located between the sprinklers 100. The sprinklers 100 are positioned a certain minimum distance from the obstructions 404. In the following embodiments, the sprinklers 100 are positioned at least 3 feet from the obstructions 404.

For example, in a first embodiment, the nominal storage height is 25 feet and the nominal building height is 30 feet. The sprinklers 100 are connected to the piping network at about 12 inches below the ceiling (i.e., building height) and three feet above the commodity, and the piping network is capable of supplying fluid to the connected sprinklers 100 at a minimum of 30 pounds per square inch. The sprinkler preferably has a K-factor of 25.2 gpm/(psi)$^{1/2}$. In FIG. 4, two rows of sprinklers 100 are spaced at a nominal spacing of 14 feet. However, in other embodiments, the sprinklers 100 may be spaced apart at other nominal spacings, such as at least 12 feet. In FIG. 4, the sprinklers 100 are spaced 14 feet apart above a first commodity storage array 402*a* and a second commodity storage array 402*b*, both of which are arranged as double row racks. The aisle width between the storage arrays 402*a* and 402*b* is a minimum of 4 feet.

FIG. 5 shows a plan view of the sprinkler system 400 shown in FIG. 4, in which a plurality of sprinklers 100 are spaced apart from one another in a grid pattern above the first and second commodity storage arrays 402*a*, 402*b*. The sprinklers 100 are spaced apart at a nominal sprinkler spacing of 14 feet. Such sprinklers 100 are preferably configured according to the embodiments described herein and in U.S. patent application Ser. No. 11/408,868, now U.S. Pat. No. 7,624,812. In the event of a fire condition sensed by a thermally responsive element of one or more of the sprinklers 100 connected to the piping network (not shown), and the one or more sprinklers 100 are thus activated, fluid is delivered to each activated sprinkler 100 at a pressure of at least 30 psi. In the first embodiment, up to six sprinklers 100 are provided to effectively protect an area of about 1200 square feet containing class I-IV and Group A cartooned, unexpanded plastics, as discussed above. It should be noted that while up to six sprinklers 100 may be provided, fewer than that number of sprinklers 100 may activate during a fire condition. The system demand during sprinkler activation is nominally 830 gallons per minute. When the demand coverage area is 1200 square feet or less, the hose stream allowance is 250 gallons per minute for 1 hour, while for demand areas greater than 1200 square feet, the hose stream allowance is 500 gallons per minute for 1.5 hours. Moreover, while FM Global limits the system design criteria to a minimum of six sprinklers per 1200 square feet, further testing indicates that, in another embodiment of the invention, as few as four sprinklers 100 can be provided to satisfy the testing requirement set by FM Global for coverage of an area of 1200 square feet. The reduction in the required number of sprinklers 100 for the given coverage area is advantageous because the water demand can be reduced while also reducing the cost and complexity of the system 400.

In a second embodiment of the method, a plurality of sprinklers 100 having a K-factor of 25.2 gpm/(psi)$^{1/2}$, such as those sprinklers configured herein and according to U.S. patent application Ser. No. 11/408,868 (U.S. Pat. No. 7,624,812), are provided and connected to the piping network at a sprinkler spacing of 12 feet. As shown in FIG. 5, the sprinklers 100 are connected to the piping network below the ceiling of a building having a nominal building height of 35 feet. Moreover, the sprinklers 100 are located above the first and second commodity storage arrays 402*a*, 402*b*, shown in FIGS. 4 and 5, having a nominal storage height of 30 feet. The sprinklers 100 are positioned 3 feet above the top of the first and second commodity storage arrays 402*a*, 402*b*. In the event of a fire condition sensed by a thermally responsive element of one or more of the sprinklers 100, and the one or more sprinklers 100 are thus activated, fluid is delivered to each activated sprinkler 100 at a pressure of at least 40 psi. In the second embodiment, up to nine sprinklers 100 are provided to protect an area of about 1200 square feet containing class I-IV and Group A cartoned unexpanded plastics discussed above. The system 400 demand during sprinkler activation is nominally 1435 gallons per minute.

In a third embodiment of the method, a plurality of sprinklers 100 having a K-factor of 25.2 gpm/(psi)$^{1/2}$, such as those sprinklers 100 configured as described herein and according to U.S. patent application Ser. No. 11/408,868 (U.S. Pat. No. 7,624,812), are provided and connected to the piping network at a sprinkler spacing of 12 feet. As shown in FIG. 5, the sprinklers 100 are connected to the piping network below a ceiling of a building having a nominal building height of 40 feet. Moreover, the sprinklers 100 are located above the first and second commodity storage arrays 402*a*, 402*b* having a nominal storage height of 35 feet. The sprinklers 100 are positioned 3 feet above the top of the first and second commodity storage arrays 402*a*, 402*b*. In the event of a fire condition sensed by a thermally responsive element of one or more of the sprinklers, and the one or more sprinklers 100 are thus activated, fluid is delivered to the activated sprinkler(s) at a pressure of at least 60 psi. In the second embodiment, up to six sprinklers are provided to protect an area of about 1200 square feet containing classes I-IV and Group A cartoned unexpanded plastics discussed above.

In another aspect of the invention, a fire protection sprinkler system includes at least one sprinkler configured as described herein, and connected to a fluid supply conduit configured to supply fluid to the activated sprinklers at a certain pressure, such as the system shown in FIGS. 4 and 5. The sprinklers have a nominal K-factor of at least 14 gpm/(psi)$^{1/2}$ and are connected to the fluid supply conduit at a spacing of at least 12 feet×12 feet. The sprinkler connected to the fluid supply conduit is configured to deliver fluid over an area of at least 144 square feet over an occupancy hazard including classes I-IV and Group A cartoned unexpanded plastics, as defined by National Fire Protection Association Standard 13 and FM Global Property Loss Prevention Data Sheets 8-1 and 8-9, stored in a storage area defined by a building height of at least up to 30 feet and a storage height of the hazard of at least 25 feet, when the pressure of the fluid entering the sprinkler is at least 30 pounds per square inch. An example of a fire protection sprinkler system in accordance with the invention is shown in FIGS. 4 and 5, in which the sprinklers are connected to the fluid supply conduit at a certain distance below the ceiling (at the building height) and above the commodity (the storage height). For example, in one embodiment, the sprinklers are positioned one foot below the ceiling and about 4 to 5 feet away from the commodity, but at least 3 feet away. In one embodiment the sprinklers are spaced in a grid 14 feet apart from one another above the commodity, as shown in FIG. 5. Various embodiments of the fire protection sprinkler system can be configured using the various embodiments of the fire protection sprinklers described herein.

At least one of the advantages of the extended coverage sprinkler, method, and system described herein are elimination of the need for in-rack sprinklers (assuming storage is at least 3 feet below the deflector) while simultaneously providing extended coverage, low pressure, and low flow fluid operation. As a result, the sprinklers, method, and system increase the flexibility of locating storage areas within a building and provide the opportunity to reduce the labor and fire sprinkler system infrastructure costs that would be required for some other types of sprinklers, such as early-suppression fast-response (ESFR) and control mode density-area (CMDA) sprinklers.

While the present invention has been described with respect to what are, at present, considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A method of providing automatic fire protection for a storage area defined by a storage height of at least twenty-five feet and a building height of at least thirty feet, the storage area storing commodity hazards including classes I to IV and Group A cartoned, unexpanded plastics, as defined in National Fire Protection Association Standard 13 and in FM Global Property Loss Prevention Data Sheets 8-1 and 8-9, the method comprising:

(A) providing a fire protection sprinkler system that includes:

(a) a piping network provided in the building over the storage area; and (b) a plurality of pendent, control mode specific application, extended coverage fire protection sprinklers, each of the plurality of pendent fire protection sprinklers having:

(i) a body that includes:

(1) an input orifice at an input end, the input orifice having a diameter of one inch national pipe thread (NPT);

(2) a threaded portion on an outer surface of the input end of the body, the threaded portion being configured to connect to the piping network;

(3) an output orifice at an output end; and (4) an axial fluid passage that extends between the input orifice and the output orifice;

(ii) a seal cap configured to seal the output orifice;

(iii) two frame arms that extend from the output end of the body and meet at a hub positioned below the output orifice;

(iv) a thermally responsive element positioned between the hub and the seal cap, the thermally responsive element being configured (1) to hold the seal cap in the output orifice, and (2) to release the seal cap when ambient temperature reaches a predetermined temperature; and (v) a deflector mounted to the hub, the deflector including a circular, planar disk that is centered on an axis of the fluid passage, and having a number of slots arrayed around a periphery, the deflector being configured to distribute the fluid to a coverage area of the storage area, the number of slots includes a first set of slots, a second set of slots, a third set of slots and a set of angled slots, wherein a center line of the angled slots forms an angle of about 20°-50° with respect to a radial line extending from a center of the deflector through inner ends of the angled slots, the inner ends of the angled slots are positioned about 15°-30° from the nearest slot of the first and second sets of slots, and the third set of slots form an angle of about 40°-50° with the first and second sets of slots;

wherein each of the plurality pendent fire protection sprinklers has a K-factor of at least 25.2 gpm/(psi)½;

(B) installing each of the plurality of pendent fire protection sprinklers in the storage area, so that the deflector of each of the plurality of pendent fire protection sprinklers is positioned at a height that is at least three feet greater than the storage height, and at least one foot below the building height, the installing including:

(a) connecting each of the plurality of pendent fire protection sprinklers to the piping network; and (b) arranging up to six of the plurality of pendent fire protection sprinklers to cover the coverage area of up to twelve hundred square feet of the storage area;

(C) activating at least one of the plurality of pendent fire protection sprinklers in the event of a fire condition sensed by the thermally responsive element; and (D) delivering the fluid, supplied to each of the plurality of pendent fire protection sprinklers from the piping network, to be output by each of the at least one activated pendent fire protection sprinkler to a coverage area of greater than 110 and up to and including 196 square feet per each of the at least one activated pendent fire protection sprinkler, and at a pressure of at least 60 pounds per square inch.

2. The method according to claim 1, wherein the arranging includes arranging up to nine of the plurality of pendent fire protection sprinklers to cover the area of twelve hundred square feet of the storage area.

3. The method according to claim 1, wherein the storage height is up to and including thirty-five feet, and the building height is up to and including forty feet.

4. The method according to claim 3, wherein the arranging includes arranging up to fourteen of the plurality of pendent fire protection sprinklers to protect the storage area.

5. The method according to claim 1, wherein each of the plurality of pendent fire protection sprinklers is configured to be in compliance with FM Global Property Loss Prevention Data Sheet 2-7.

6. The method according to claim 1, wherein, when the plurality of pendent fire protection sprinklers is connected to the piping network, each pendent fire protection sprinkler of the plurality of pendent fire protection sprinklers is positioned at least three feet away from an obstruction located in the storage area.

7. The method according to claim 1, wherein the deflector of each of the plurality of pendent fire protection sprinklers has a diameter of about 1.6 inches to about 2.1 inches.

8. The method according to claim 1, wherein the deflector of each of the plurality of pendent fire protection sprinklers comprises:

(i) the first set of slots, are positioned at ninety degrees relative to each other on the deflector;

(ii) the second set of slots are positioned at an angle relative to one of the first set of slots; and (iii) the plurality of angled slots are positioned between one of the first set of slots and one of the second set of slots.

9. The method according to claim 8, wherein each of the first set of slots has a radial length of about 0.4 inch to about 0.5 inch.

10. The method according to claim 8, wherein each of the second set of slots has a radial length of about 0.5 inch to about 0.7 inch.

11. The method according to claim 8, wherein each of the plurality of angled slots has a radial length of about 0.15 inch to about 0.20 inch.

* * * * *